US005596857A

United States Patent [19]

Besche

[11] Patent Number: 5,596,857

[45] Date of Patent: Jan. 28, 1997

[54] MASONRY REINFORCEMENT

[76] Inventor: Charles F. Besche, 30 Severnadale Rd., Severna Park, Md. 21146

[21] Appl. No.: 347,899

[22] Filed: Dec. 1, 1994

[51] Int. Cl.[6] ..... E04B 2/48

[52] U.S. Cl. ..... 52/421; 52/100; 52/293.2; 52/442; 52/503

[58] Field of Search ..... 52/98, 100, 293.2, 52/421, 439, 442, 503, 505, 562, 566, 567

[56] References Cited

U.S. PATENT DOCUMENTS

| | | | |
|---|---|---|---|
| Re. 13,980 | 9/1915 | Smith | 52/421 |
| 692,544 | 2/1902 | Record | 52/421 X |
| 1,113,585 | 10/1914 | Smith . | |
| 1,297,151 | 3/1919 | Griffin . | |
| 1,311,082 | 7/1919 | Mock | 52/421 |
| 1,625,628 | 4/1927 | Scarth . | |
| 2,013,736 | 9/1935 | Stirrup | 52/421 |
| 2,045,033 | 6/1936 | Kissinger | 52/421 |
| 2,055,184 | 9/1936 | Stirrup | 52/421 |
| 2,176,986 | 10/1939 | Briscoe | 52/293.2 |
| 2,325,653 | 8/1943 | Bingham . | |
| 2,776,559 | 1/1957 | Summers . | |
| 3,780,773 | 12/1973 | Haugen | 52/421 X |
| 4,375,143 | 3/1983 | Godlewski | 52/421 X |
| 5,193,320 | 3/1993 | Coccagna | 52/442 |

*Primary Examiner*—Carl D. Friedman
*Assistant Examiner*—Kevin D. Wilkens
*Attorney, Agent, or Firm*—Leonard Bloom

[57] ABSTRACT

A masonry reinforcement device is used in construction to strengthen the courses of laid hollow block. The masonry reinforcement device is fashioned with ends and a trough. In use, the trough will retain cement which will bind hollow block in a lower course to hollow block of an adjacent upper course.

18 Claims, 8 Drawing Sheets

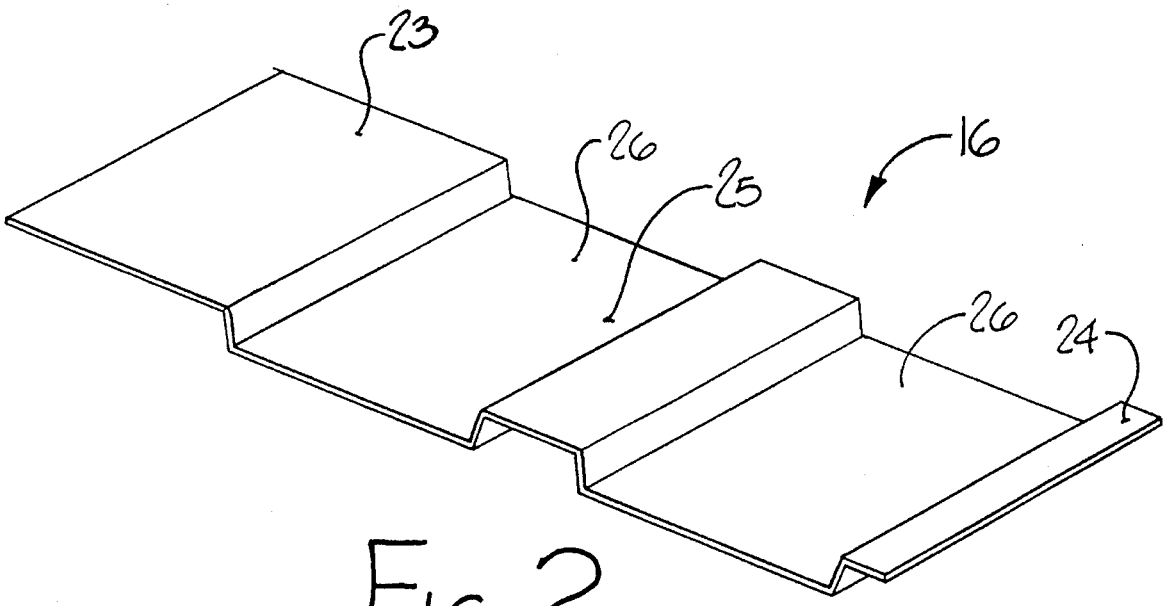
FIG. 2
FIG. 3
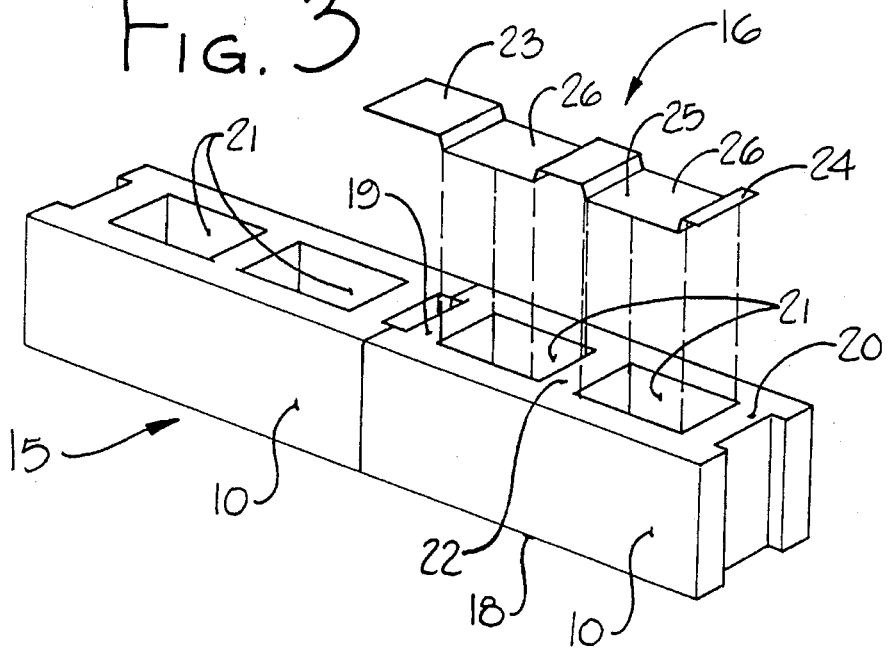

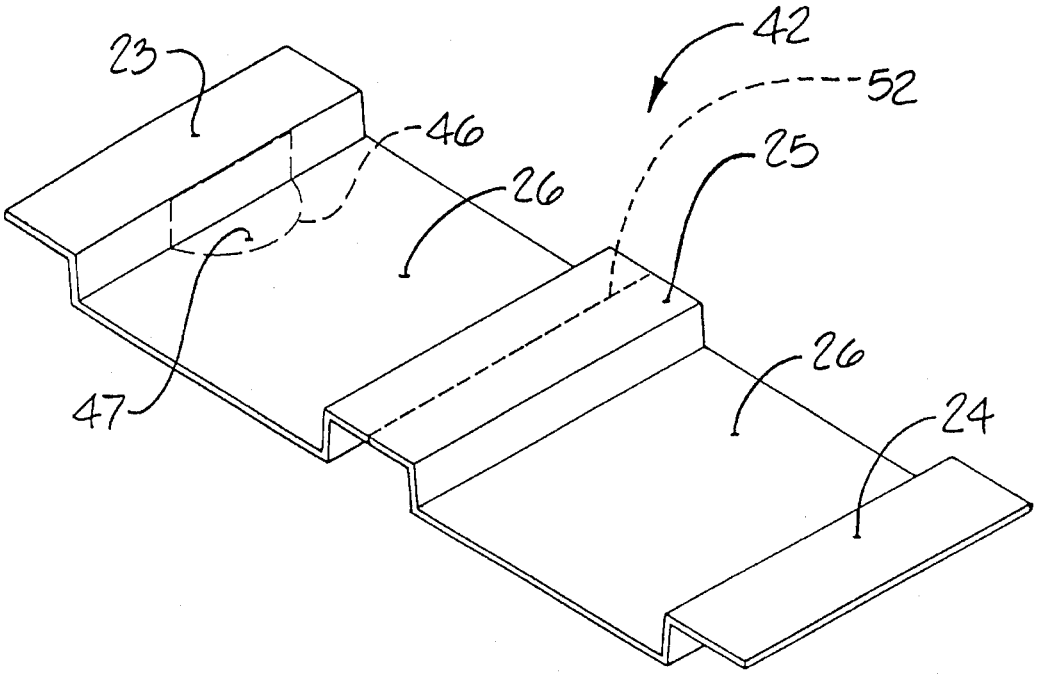
FIG. 10
FIG. 11
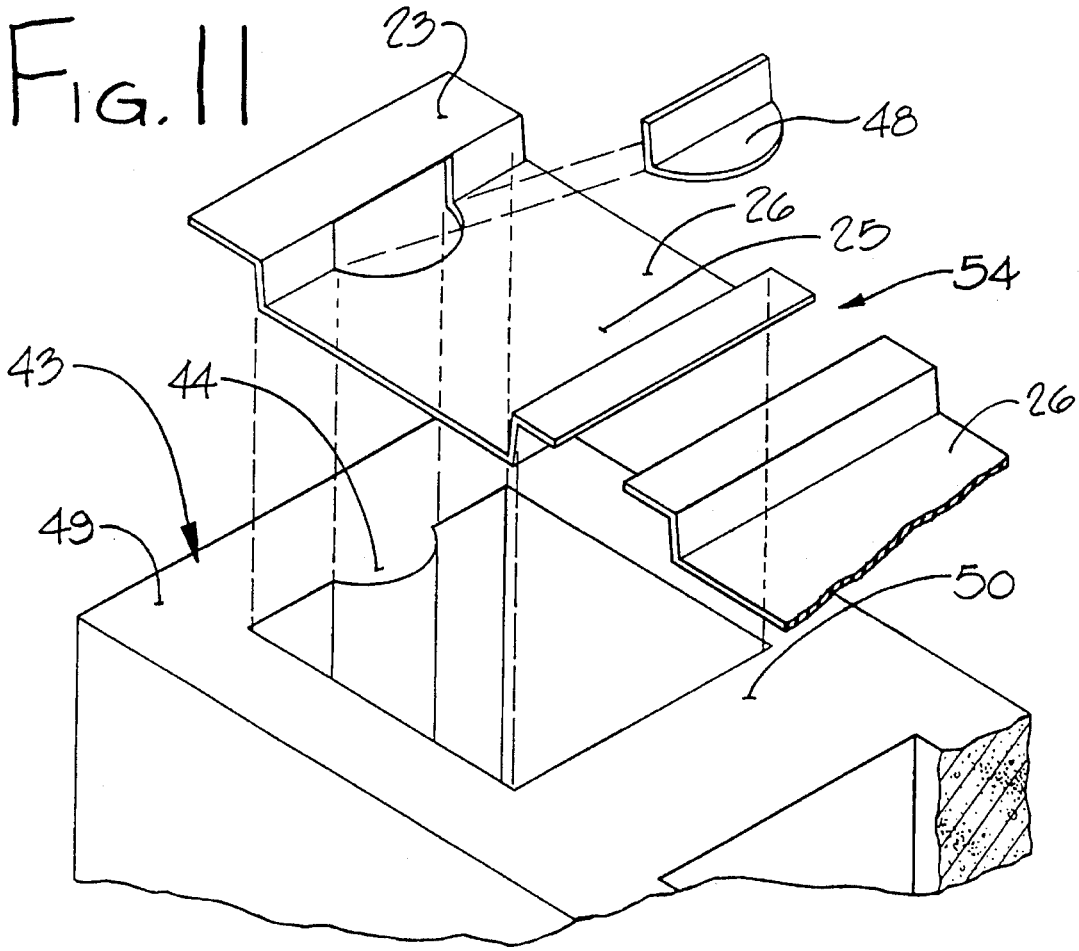

MASONRY REINFORCEMENT

FIELD OF THE INVENTION

The invention herein described relates to construction and the reinforcement of masonry block walls and structures.

BACKGROUND OF THE INVENTION

Building with block, and particularly concrete and cinder block, are types of construction well known to contractors, builders and masons.

Cinder block and concrete block are hollow-core block finding widespread use in building. This block is a well-known and conventionally used material for constructing the foundation and footings of a building. Hollow block construction is also a convenient and economical means for erecting building walls, particularly where the walls have windows and doors.

Concrete hollow block, also referred in the art as a concrete masonry unit, ("CMU") is supplied in a variety of sizes. The standard size and that most used is a block 8×8×16 (7⅝×7⅝×15⅝) inches. This block is generally manufactured to have one, two or three cells or cores. The lateral dividing walls forming the core or cells of the block are sometimes called webs. While the standard width of the conventional block is 8 inches, blocks of 4, 6, 10 and 12 inch widths are available. The blocks or CMU's generally come in two external configurations: stretcher blocks which do not have finished ends, and corner blocks which have a finished corner (that is, two finished facing sides at right angles to one another).

There is a continuing need to improve the efficiency and strength of walls built of block. In using block construction, there is a tendency for the walls to be somewhat weak and for the joints to crack. Industry continuously seeks ways of improving the strength of structures where block is used.

One prior art product used for strengthening hollow block construction is a wire-mesh or grid called "Durowire"; others are Block mesh, Truss wire and Block wire. This product is designed to strengthen mortar joints between courses of block. In use, a course of block is laid and then mortar is enmeshed in the wire or grid. Then a second course of block is laid over the wire mesh and mortar of the first course of block. While this wire product supplies lateral strength, horizontally block to block, it does not supply substantial vertical strength between the vertical courses of adjacent block.

Unlike the wire mesh method, the method of this invention accomplishes adjacent vertical bonding between blocks, strength is increased and cracks in the mortar joints reduced.

Still another prior art method of block wall construction involves mortar poured directly into the hollows or cavities of the block to strengthen the wall. While this type of wall is strong, there are disadvantages. Firstly, this type of wall is costly to build due to the added mortar required to fill the entire cavity of the block. Secondly, there is a need to wait for the mortar between the joints of the block to set-up before mortar can be poured into the hollows. If pouring is done before set-up, the mortar poured into the hollows will force the still wet mortar out of the joints. It is clear that with the pour method, valuable time is lost because the steps of the pouring process are time-consuming.

A still further type of construction uses poured concrete walls rather than block. While the poured concrete method has the advantage of strength, it requires on-site forms; and it is not an efficient method of construction where doors and windows have to be placed in the wall.

The patent literature describes prior art showing various means and methods for reinforcing and strengthening construction in which hollow block is used.

Smith in U.S. Pat. No. 1,113,585 discloses a binder for hollow tile building blocks. The binder has slots through which cement flows to bind one row of block with the other. In addition to the slots, the binder is wide enough to catch and contain cement, thus preventing the cement from falling into the hollows of the blocks.

U.S. Pat. No. 1,297,151 to Griffin discloses a building block with notches for receiving reinforcing rods carried in the notches. A metal plate is fixed below the notches to receive cement which is retained therein to seal the rods in the notches.

A device for tile closure is taught by Scarth in U.S. Pat. No. 1,625,628. The device is designed to close the ends of tile used in building construction to prevent cement from entering the hollows of the block. This tile closure device is useful for sealing the hollows of tile block when cement is poured in areas adjacent to the block. The closure device thereby saves cement which would have been wasted during the pouring process.

Bingham in U.S. Pat. No. 2,325,653 teaches a wall construction system employing a spacer element placed between the rows or courses of block to prevent water seepage through the cement bonds between the rows of block. The spacer element also prevents cement from falling into the hollows of the block, thus saving cement.

In U.S. Pat. 2,776,559 Summers teaches the reinforcement of block wall construction by placing spacers between the courses of block along with reinforcing wire supported between the courses of brick.

None of the prior art patents discloses a contoured insert fitting between the courses of hollow block in such a way that mortar when poured into the hollow of a top block will internally, and within the cell, bind the top block to the bottom block.

SUMMARY OF THE INVENTION

The primary object of the disclosed invention is the reinforcing of hollow block (e.g., hollow concrete block) used in various types of construction.

A further object of this invention is to tie a lower course of hollow block to an adjacent upper course of hollow block, producing added lateral and vertical stability to the rows of hollow block.

A further object of this invention is to provide a means for reinforcing courses of block efficiently and economically.

The objects of this invention are realized through the use of masonry reinforcement plates or strips. These plates or strips are shaped to form troughs when they are placed over the hollows of the masonry block. In use, a bottom or first course of block is laid. The reinforcement plate is placed on the top of the block and within the hollow. Mortar is then applied to the first course of block. A second course of block is set on top of the first course of block, as well as over the masonry reinforcement plate. Mortar is then dropped into the hollow of the block of the second or top course. The dropped mortar lands onto the trough of the masonry reinforcement plate and builds up to internally key or bind the first course of block to the second. The depressed trough or pocket of the plate catches the dropped mortar, thereby facilitating the keying and bonding of the bottom block to the adjacent top block using a minimum amount of mortar.

It is evident that this inventive process using the masonry reinforcement plates, unlike processes in which the entire cavity is filled, saves mortar and at the same time provides vertical block-to-block binding or keying between the courses of block. In addition unlike the process where the entire hollow of the block is filled, there is no need to wait before dropping mortar into the hollow since the rather small amount of mortar added to the hollow will not be enough to force mortar from between the courses of laid block.

The masonry reinforcement device can be fashioned with a trough to fit over a single hollow cell or over a double hollow cell. The reinforcement device can also be fashioned with troughs to fit over multiple hollow cells and straddle the lateral dividing wall of a single block or the two lateral end walls of adjoining block in a course. The trough must be deep enough to hold adequate mortar for keying a bottom block, usually ¼" to ¾".

As an added feature, the reinforcement device of this invention is fashioned to accommodate the outdent in the hollow cell of a corner block; or the outdent which can be found in various block, other than corner block. The reinforcement strip is made with perforations outlining a knock-out for the outdent. Ordinarily, an entire strip is used over the block. The strip is manufactured with perforations or break-points, which make breaking off of the knock-out easy. With the knock-out removed the reinforcement strip can accommodate the outdent of a corner block or any other block having an outdent. As a unique feature of this invention, a single strip with perforations can be used on block, either with or without the outdent; when used on a block with an outdent, simply remove the knock-out. Along with the outdent knock-out the strip can be manufactured with a lateral perforation to split or separate the strip so that it will be able to be positioned over a wider center lateral wall in corner block.

As described above, hollow block is generally produced with one, two or three cells or hollows. The masonry reinforcement of this invention will generally be described as being applicable to the hollow block of two cells or hollows. It is clear, however, that the masonry reinforcement device as generally defined by this invention can find applicability to block of one or three cells or to an extended series of cells presented by the laying of a course of block.

As an embodiment of this invention there is described a masonry reinforcement device for reinforcing courses of hollow block in masonry construction. Said hollow block is of a rectangular configuration, and has a top first end, a top second end and two exposed hollow cells formed by a lateral wall in the center of said hollow block. Said masonry reinforcement is made of stiffened material and comprises a first end, a second end and an elongated surface between said first end and said second end. The first end and second end of said masonry reinforcing device are shaped to fit on the top first end and top second end of said hollow masonry block, respectively. The elongated surface between said first end and said second end of the masonry reinforcing device defining two troughs to be positioned over said two exposed hollow cells and lateral wall. When the masonry reinforcement device is positioned over exposed hollow cells of hollow masonry block in a bottom course of hollow block, a top course of hollow masonry block is set over the block in the bottom course of block and an adequate amount of mortar dropped into the exposed hollow cells of the top masonry block, the dropped mortar will land in said troughs to bind and adhere the interior hollow cell surfaces of both the bottom hollow block and the top hollow block and thereby form a secure bond between the blocks.

A special embodiment of this invention describes a masonry reinforcement device for reinforcing courses of hollow block in masonry construction. Said hollow block is of a rectangular configuration, and has a top first end, a top second end and two exposed hollow cells formed by a lateral wall in the center of said hollow block. Said masonry reinforcement device being made of stiffened material and comprising a first end, a second end and an elongated surface between said first end and said second end. The first end and second end of said masonry reinforcing device being shaped to fit on the top first end lateral wall in the center of said hollow masonry block, respectively. The elongated surface between said first end and said second end of the masonry reinforcing device defining a trough to be positioned over a single cell in said block. When said masonry reinforcement device is positioned over an exposed cell of hollow masonry block in a bottom course of block, a top hollow masonry block is set over the bottom block and an adequate amount of mortar dropped into the exposed hollow cell of the top masonry block, the mortar will land in said trough to bind and adhere the interior hollow cell surfaces of both the bottom and top hollow masonry block and thereby form a secure bond between the blocks.

Another special embodiment of this invention describes a masonry reinforcing device designed to be applied over two adjacent abutting hollow blocks in a course of hollow block in masonry construction. Each of said abutting hollow blocks has a rectangular configuration, a top first end, a top second end and two exposed hollow cells formed by a lateral wall in the center of said hollow block. The two adjacent abutting hollow blocks presenting a top first end, a remote top second end, lateral walls and a thickened center section formed by the juxtaposition of abutting end walls of the adjacent abutting hollow block. Said masonry reinforcement device being made of stiffened material and comprising a first end, a remote second end and an elongated surface between said first end and said remote second end. The first end and remote second end of said masonry reinforcing device being shaped to fit on the top of said first end of said two adjacent abutting hollow blocks and said remote top second end of said two adjacent abutting hollow blocks. Said elongated surface between said first end and remote second end of said masonry reinforcement device being shaped to fit over the lateral walls and thickened center section formed by the juxtaposition of abutting end walls of said adjacent hollow block, and with said elongated surface forming several troughs to fit into said exposed hollow cells formed by said lateral walls in the center of said hollow blocks. When the masonry reinforcement device is positioned over exposed hollow cells of hollow masonry blocks in a bottom course of block, and a top course of hollow masonry block is set over the bottom course of block and an adequate amount of mortar dropped into an exposed hollow cell of the top masonry block, the mortar will land in said troughs to bind and adhere to the interior hollow cell surfaces of both the bottom and top hollow masonry blocks and thereby form a secure bond between the blocks.

As a unique embodiment the masonry reinforcement device has at its first end a perforated knock-out for accommodating an outdent in the cell of hollow masonry block, e.g. a corner block. The knock-out can be removed and the masonry reinforcement device can accommodate said outdent.

The herein disclosed invention envisions a building wall, wherein at least two hollow core masonry blocks are stacked vertically and are staggered longitudinally. The blocks including an upper block and a lower block and having respective communicating cores formed therein. The blocks having respective flat surfaces between which mortar is placed. Said building wall being in combination with a masonry reinforcing device disposed between the upper and lower blocks and including at least one trough portion which is received within the core of the lower block, such that additional mortar may be dropped through the core of the upper block to fall into the trough portion of the masonry reinforcing device in the lower block. The additional mortar being sufficient to be disposed conjointly between the respective cores of the upper and lower blocks, thereby vertically keying the upper and lower blocks together for substantially increased vertical or lateral strength of the building wall, and such that the additional mortar does not displace the mortar between the respective flat surfaces of the upper and lower blocks. Said combination can further comprise the masonry reinforcing device having a strip disposed between the respective flat surfaces of the upper and lower blocks. The strip can have a length substantially aligned with the longitudinal axis of the building wall and further having a width slightly less than the width of the respective cores in the upper and lower blocks, and with the strip being bent at angles to the length thereof to form the at least one trough portion in the strip.

As a special feature the masonry reinforcement device has at its elongated surface between the first end and second end, and between troughs a lateral perforation for separating the reinforcement device and thereby accommodating the thickened lateral portion of corner block. Besides said lateral perforation the reinforcement device at its first end can have a perforated knock-out for accommodating an outdent in the cell of hollow masonry block.

The masonry reinforcement device of this invention can be used in conjunction with "Durowire", Block mesh, or Truss wire, etc. In that way there will be added bonding strength.

BRIEF DESCRIPTION OF THE DRAWINGS

FIG. 2 is a perspective view illustrating the masonry reinforcement device of this invention.

FIG. 3 is a perspective a view illustrating the masonry reinforcement device of this invention as it would be applied to masonry hollow block for reinforcement.

FIG. 10 is a view illustrating the masonry reinforcement device with the attached perforated knock-out for the outdent of the corner block and a lateral perforation.

FIG. 11 is a view illustrating a separated masonry reinforcement device with the outdent knock-out removed; part of the reinforcement is broken away.

For clarity of illustration, the mortar has been omitted from between the blocks depicted in FIGS. 1, 3–5, 7 and 9; and in FIGS. 1, 3, 4, 8, 9 and 11, the broken lines indicate the placement of the reinforcement device onto the hollow block.

GENERAL DESCRIPTIONS OF THE PREFERRED EMBODIMENTS

Figure 1:
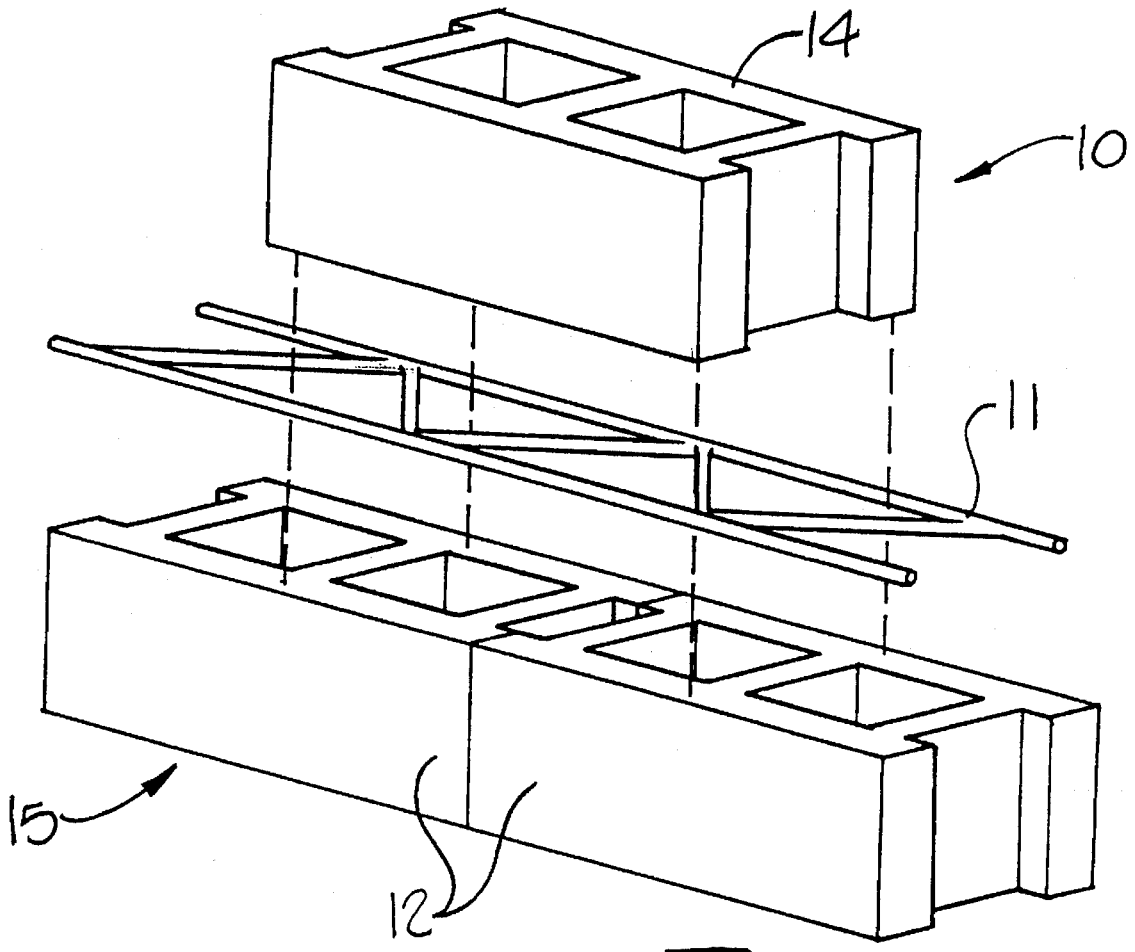
FIG. 1 PRIOR ART
FIG. 1 is a perspective view illustrating the prior art method employed for reinforcing hollow block masonry construction.
Figure 4:
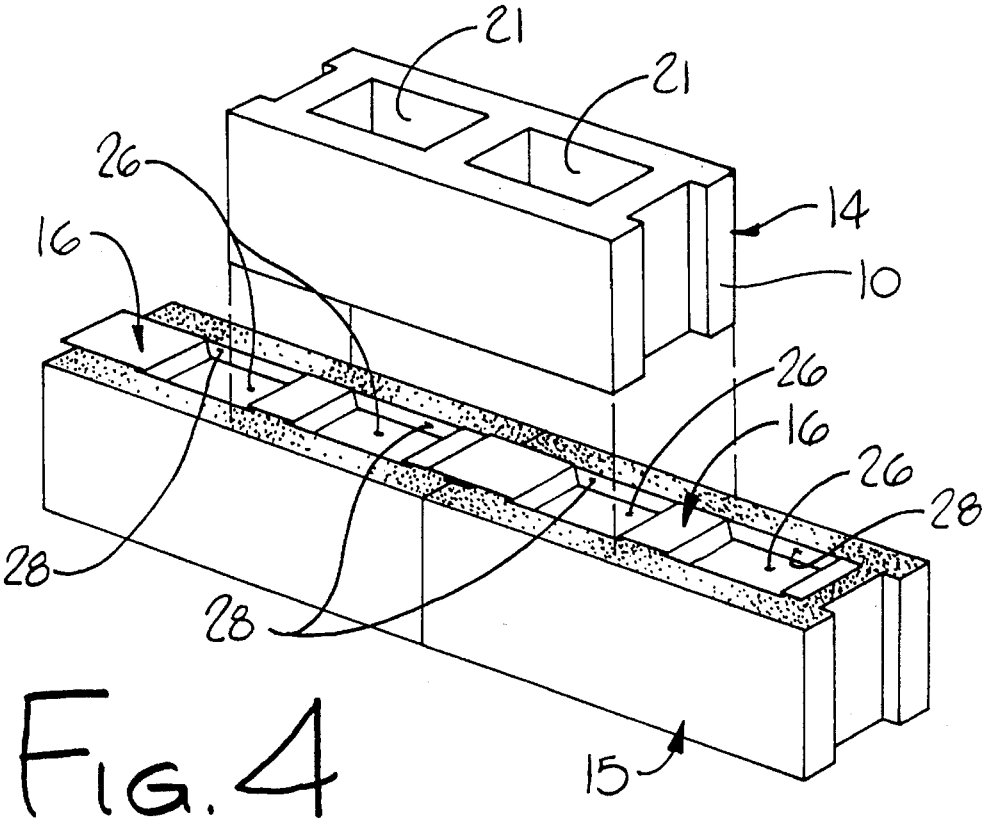
FIG. 4 is a perspective a view illustrating the application of a hollow block over the set reinforcement device.
Figure 5:
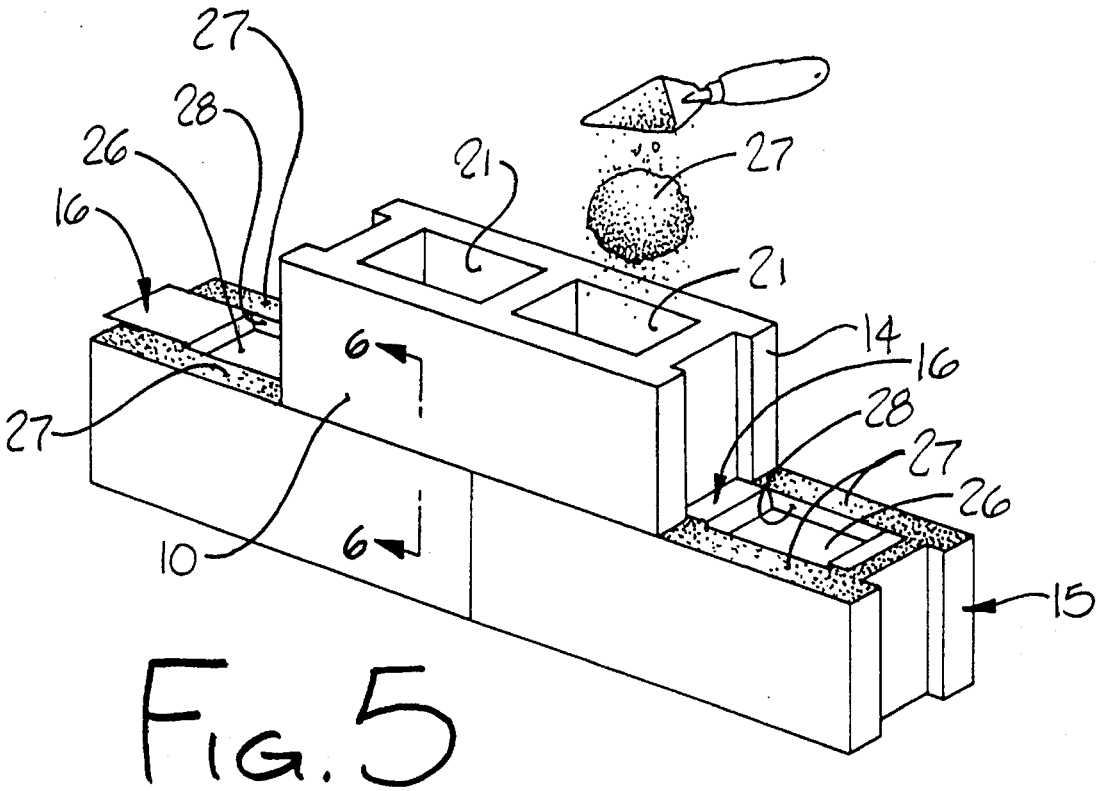
FIG. 5 is a perspective view illustrating dropping mortar into the hollow of the block with the reinforcement in place.

With reference to FIG. 1, the prior art method of bonding hollow block 10 uses "Durowire" 11, Truss wire or Block mesh between the courses of block 10 for strengthening. This method strengthens horizontal, block to block bonding 12 in a given course, but does not substantially strengthen vertical bonding. It is noted that top block 14 is in a offset relationship relative to the blocks of the bottom 15 course. This offset relationship of block 10 serves to strengthen the wall 17 (shown in detail in FIG. 7).

Figure 6:
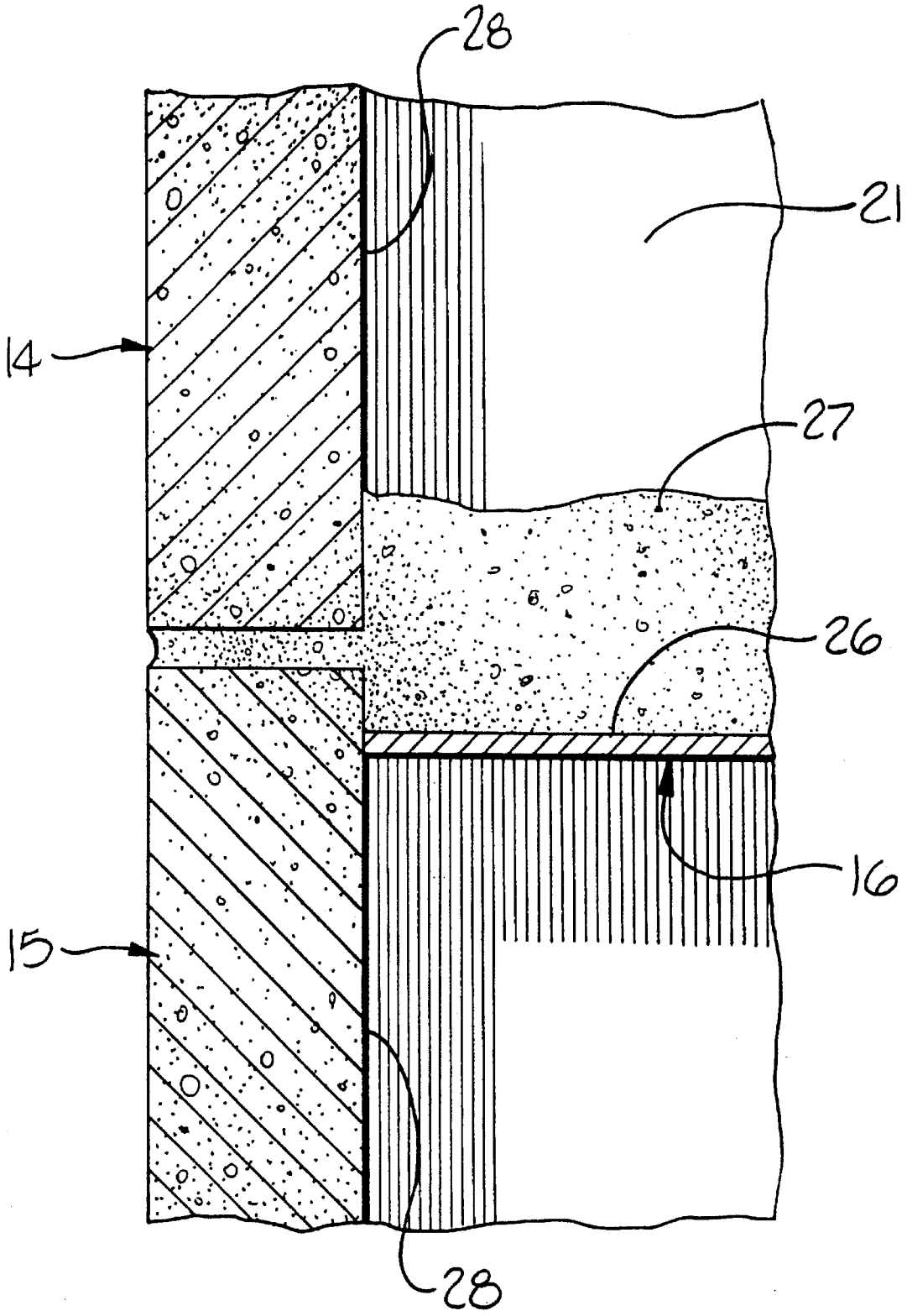
FIG. 6 is a cross-sectional view taken along lines 6—6 of FIG. 5, showing the second course of block with the reinforcement in place and mortar, dropped in the trough, and binding the top and bottom blocks to one another.

The masonry reinforcement device 16 of this invention (FIG. 2) is placed over a block 10 laid in a first or bottom course of block 15 (FIG. 3). The dashed lines show the final positioning of the masonry reinforcement device 16 over the hollow block 10. The hollow block 10 has a rectangular configuration 18, a top first end 19, a top second end 20 and two exposed hollow cells 21 formed by a lateral wall 22 in the center of the hollow block 10. The masonry reinforcement device 16 has a first end 23, a second end 24, and an elongated surface 25 between said first end 23 and the second end 24 of the reinforcement device. The first end 23 and second end 24 of the masonry reinforcement device 16 is shaped to fit on the top of the first end 19 and top second end 20 of the hollow block 10, respectively. The elongated surface 25 between the first end 23 and second end 24 of the masonry reinforcement device 16 is shaped to define two troughs 26 to be positioned over the two exposed hollow cells 21 and lateral wall 22. Once the masonry reinforcement device 16 is set in place (FIG. 4) and mortar 27 dropped into the exposed hollow of the cell 21 of the top block 14 (FIG. 5), the mortar 27 will land onto the trough 26 under the hollow of top cell 21 (FIG. 5 and 6) and bind and adhere to the interior cell surfaces 28 of both the bottom 15 and top blocks 14.

The amount of mortar 27 to be dropped into the top of the hollow cell 21 can vary. Ordinarily, a half of a trowelful will be adequate to provide keying and binding of the blocks 10. Of course, the more mortar added to the cell the greater will be the binding. Ordinarily, about a quarter to three-quarters of an inch of mortar on the inner surfaces of each of the top and bottom blocks of a course will provide adequate binding.

The plate or strip 16 is dimensioned so as to fit easily into the top of the hollow cell 21. Some convenient directional movement or float of the trough 26 within the hollow 21 is desirable because of variety of dimensions of the concrete masonry units or hollow block 10. The masonry reinforcement device 16 would present no problems for running electric wires or conduit because these are generally run on the outside of the wall. Nevertheless, the reinforcement device 16 could be easily cut and shaped to accommodate any internal wire or conduit.

The masonry reinforcement device or strip 16 can be made of a variety of materials, such as for example, metal or plastic. Neither the metal or plastic has to be specially surface treated, e.g., galvanized. The only important consideration is that the strip 16 be strong enough to hold mortar in the trough. For example, thirty to twenty four gauge metal would be acceptable. The sturdiness of the material making the masonry reinforcement will ultimately depend upon the amount of binding mortar placed into the trough. It is theoretically possible to use a sheet of flexible material, such as a mesh, as the reinforcement, and have the weight of the applied mortar form the trough. It is visualized that the strip 16 would be supplied nested in packages, of one hundred strips, more or less, based on convenience. This type of packaging would make shipping and inventory control easy. As a further note, the most expedient method for manufacturing the strip 16 would be stamping from a roll of sheet metal.

Figure 7:
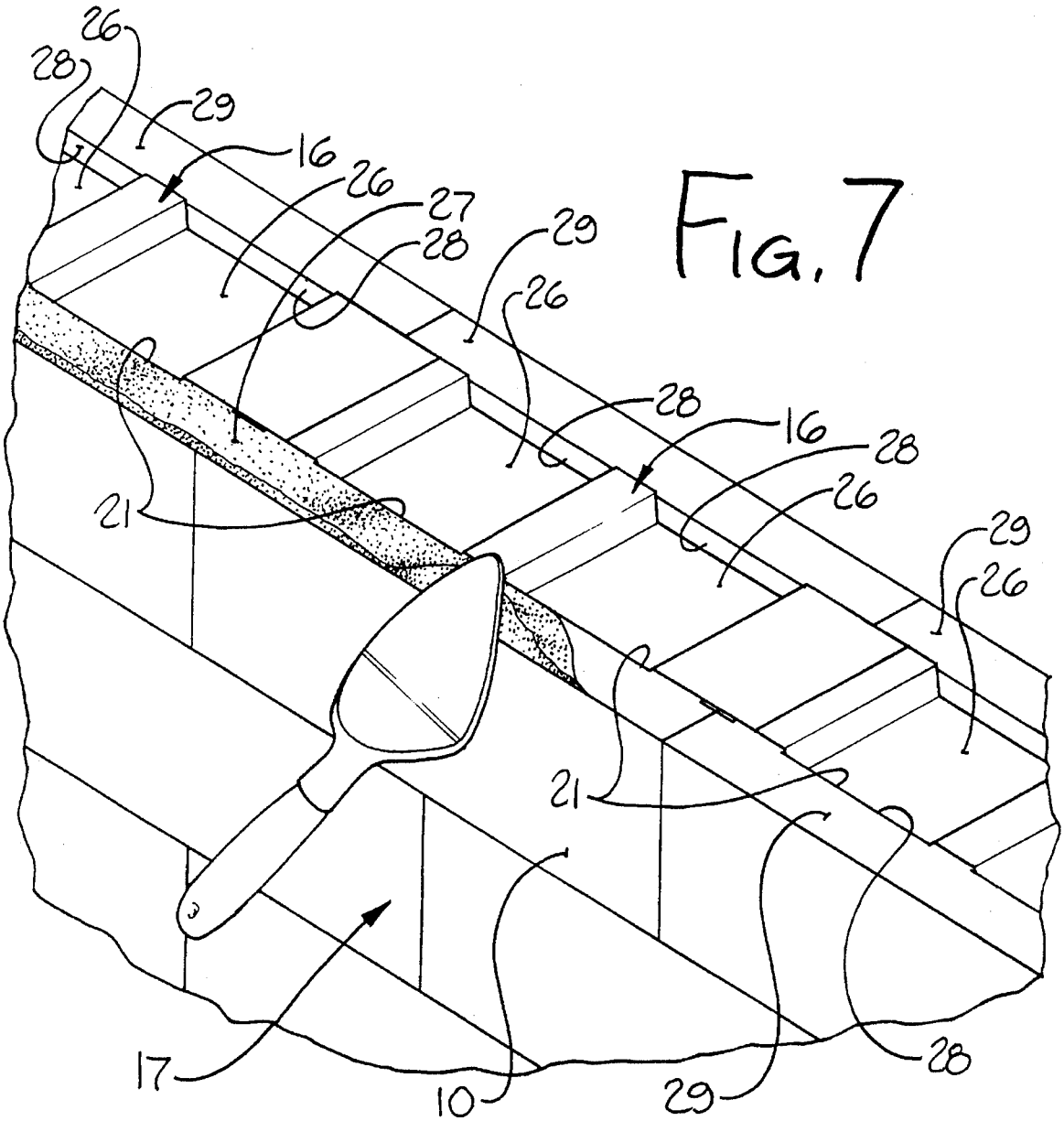
FIG. 7 is a view illustrating the application of mortar to the top edges of the hollow block set in a wall with the reinforcement device in place.
Figure 8:
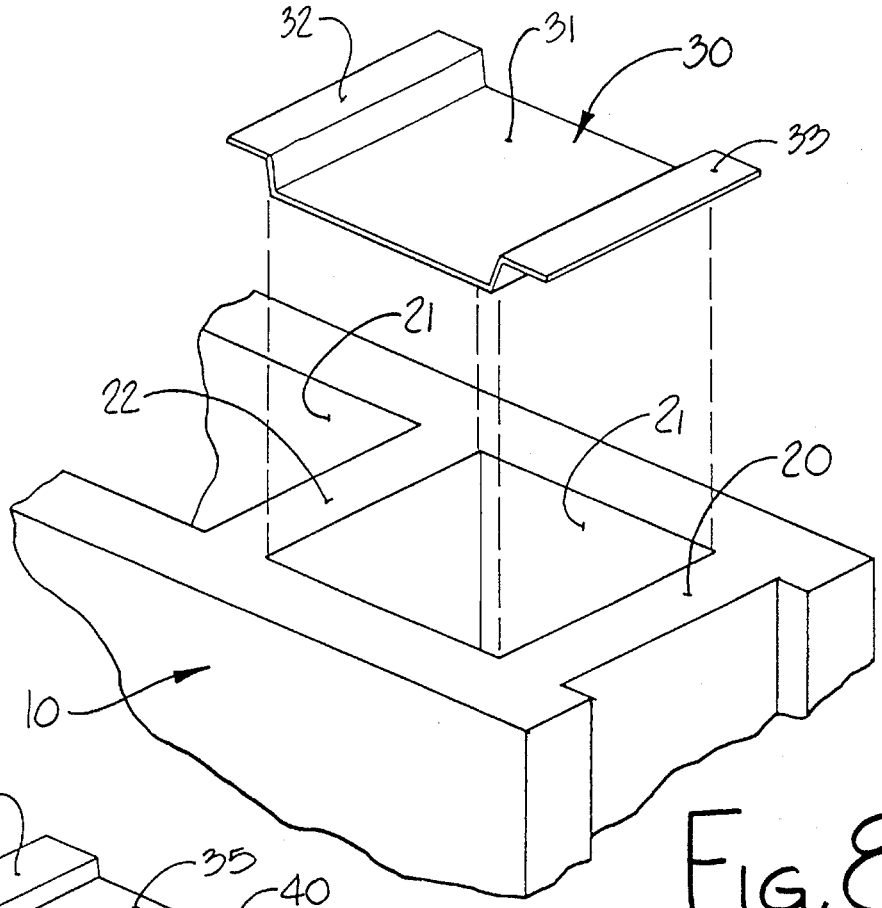
FIG. 8 is a view illustrating an alternative embodiment of the masonry reinforcement device designed to cover a single hollow cell.

Hollow block 10 construction employing the reinforcement strip 16 between the courses of block 14 and 15 is continued until the wall 17 is completed. (FIG. 7). The CMU or block 10 is laid so that the blocks 10 in each course are staggered, that is, a bottom block only abuts half of a top block.

Note that with the reinforcement device 16 in place, before mortar 27 is applied to the top edge 29 of the block 10, mortar 27 which would ordinarily drop in the hollows 21 and be lost is now caught in the trough 26 and becomes part of that mortar 27 which binds the interior of surfaces 28 of the block 10 (FIG. 7).

The masonry reinforcement device or strip 16 of this invention has alternative embodiments. For example, besides the masonry reinforcement strip 16 having two troughs 26 as exemplified in FIGS. 2–3, the reinforcement 30 can have a single trough 31 (FIG. 8) with a first end 32, second end 33 to fit over an end wall 20, and lateral dividing wall 22, respectively, as well as the hollow cell 21 of the block 10. The single trough 31 is placed between end 20 and lateral wall 22 and fits into the top of the hollow cell 21 to catch the mortar 27 dropped into the top of the cell 21 of a top block 10 (not shown) and to land onto the trough 31.

Figure 9:
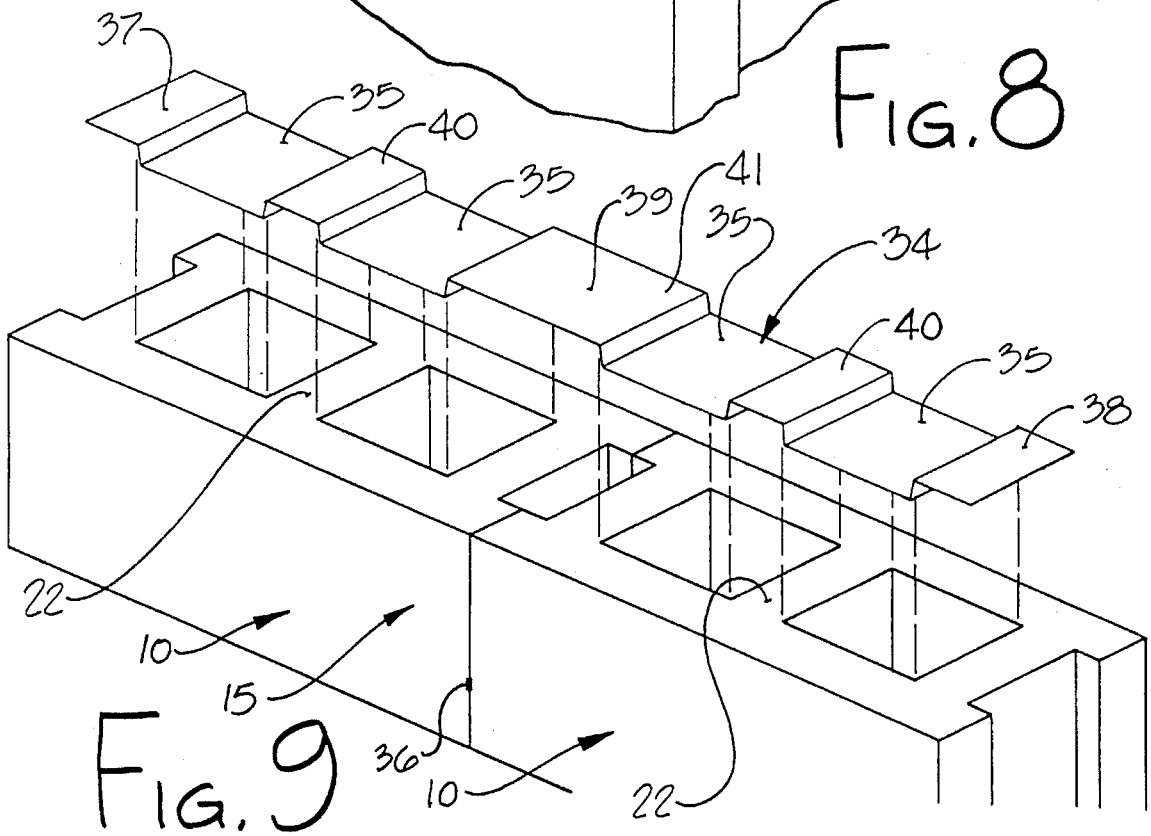
FIG. 9 is a view illustrating an alternative embodiment thereof designed to cover the hollow cells and form troughs over two blocks.

A further embodiment of this invention is a masonry reinforcement device 34 with several troughs 35 (FIGS. 9). This masonry reinforcement 34 with the several troughs 35 is designed to fit over two butting ends 36 of horizontal masonry blocks 10 set in a course 15. The reinforcement device with several troughs 34 has a first end 37, a remote second end 38 and several troughs 35. The elongated portion 39 between the two ends 37, 38 has portions 40 shaped to fit over the lateral dividing wall 22 of the hollow block 10 and a lengthened portion 41 to fit over the two butting ends 36 of adjacent block 10. While it is possible to extend the masonry reinforcement beyond that exemplified in FIG. 9, it would not be practical. This is so because with the variance in the width of the mortar joints in the courses of block, the lengthened reinforcement device may not be able to be fitted properly into position.

With reference to FIGS. 10–11, there is shown a masonry reinforcement device 42 for accommodating hollow masonry block 43 with an outdent 44. Block 43 with an outdent 44 is generally found in corner block described above. The reinforcement 42 (FIG. 10) is supplied with a perforated 46 knock-out 47 for removing the semicircle tab 48 (FIG. 11) in the reinforcement device 42 and perforations 52 for dividing the reinforcement device. Note that with reference to FIG. 11 the center lateral dividing wall 50 of the corner block 43 is wider than the center wall of stretcher block 10 (2½" vs. 1¼"). Perforations 52 or break points allow for the reinforcement device 42 to be severed 54 to accommodate the wider center lateral dividing wall 50 of the corner block 43. Of course a reinforcement device with a wider elongated surface for fitting over the wider center lateral dividing wall 50 can be made. However, supplying reinforcement devices with perforations 52 or break points will reduce the need for manufacturing and supplying multiple reinforcements. Once the semicircle tab 48 is removed and center perforation 52 broken, the reinforcement 42 will fit over the outdent 44, of the corner block 45 and over thickened center lateral dividing wall 50 in the center of the corner block 43.

The reinforcement device 42 for accommodating the outdent 44 has ends 23, 24 troughs 26 and a elongated portion 25 forming the troughs 26 and perforations 52 which can be severed for accommodating the wider center lateral dividing wall 50 of the corner block 43, or can be used unsevered on the stretcher block.

Figure 12:
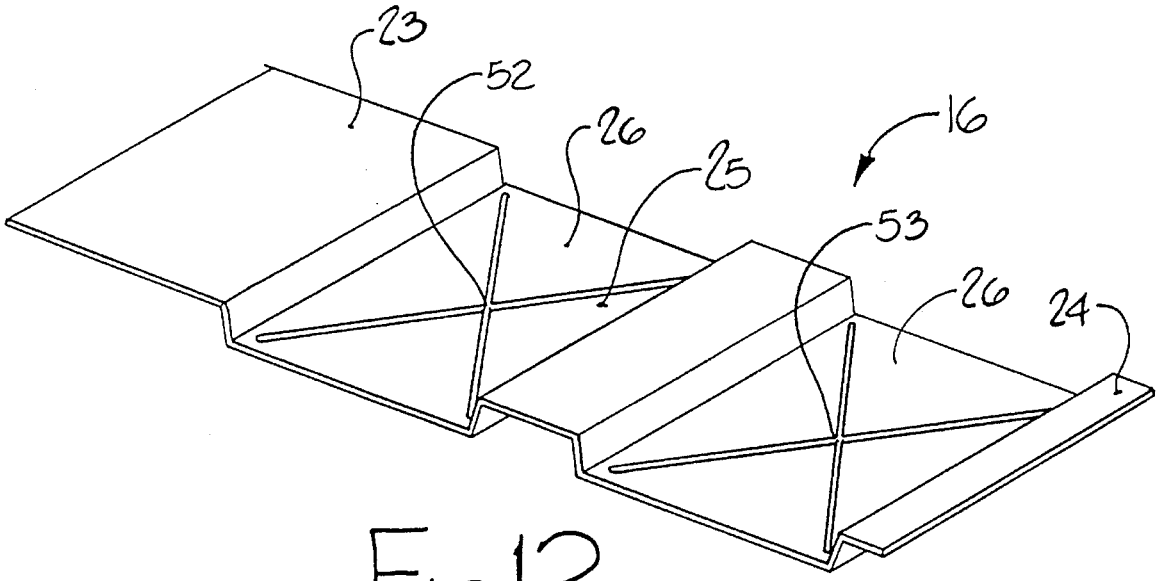
FIG. 12 is a top perspective view of an alternative embodiment of the masonry reinforcement device with a reinforced trough.

As unique embodiments of this invention, the flat bottom of the trough 26 could be modified. One modification envisions the bottom of the trough 26, instead of being flat, would have reinforcing ribs 52, 53 (FIG. 12). The trough 26 instead of having a ribs 52, 53 at the bottom could be bent for reinforcement and have a pyramid or a truncated pyramid configuration. The pyramid configuration would strengthen the trough 26, as well as, save mortar dropped into the hollow cell. A further modification of the flat trough bottom envisions parallel corrugations, which would supply strength to the trough.

Many advantages accrue through the use of this invention.

1. The masonry reinforcement device of this invention will inexpensively produce added strength to the courses of hollow block used in construction.

2. The masonry reinforcement device, unlike wire mesh reinforcement, will be supplied in individual units to provide reinforcement for a predetermined hollow block masonry unit. Therefore, no cutting to size will be required as with wire mesh; and, further, because the reinforcement is supplied in units, inventory control will be facilitated.

3. The masonry reinforcement device will allow for the economic use of cement to bind the blocks. This is so because cement will not simply be thrown into the hollow of the block to fill the hollows to bind the block; but the reinforcement device will catch a relatively small measured amount of cement, which will be enough to bind one hollow block to the other.

4. Unlike the wire reinforcement of the prior art, the masonry reinforcement device of this invention in use will leave a temporary water mark on the outside of the top and bottom block. In this way, there is an added check to determine whether the mason has properly used the masonry reinforcement device.

5. The masonry reinforcement device is easy to package, easy to ship, and easy to maintain inventory control.

6. Since the masonry reinforcement device can be provided with a perforated outdent knock-out and a lateral perforation, the same device can be used for the straight course block as well as the corner block with outdent. The only modification required when the reinforcement is to be used for a corner block outdent is to remove the perforated knock-out for the outdent, break the lateral perforation to fit the center lateral dividing wall and fit the device into the outdent and hollow of the cell. The removed second half can be used itself over another cell.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of a stiffened material consisting essentially of a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall, such that when the masonry reinforcement device is positioned over exposed hollow cells of hollow masonry block in a bottom course of hollow block, and a top course of hollow masonry block is set over the block in the bottom course of block and an adequate amount of mortar dropped into the exposed hollow cells of the top masonry block, the dropped mortar will land in said troughs to bind and adhere the interior hollow cell surfaces of both the bottom hollow block and the top hollow block and thereby form a secure bond between the blocks.

2. A masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device consisting essentially of a stiffened material and having a first end, a second end and an elongated surface between said first end and said second end, the first end and second end of said masonry reinforcing device being shaped to fit on the top first end and lateral wall in the center of said hollow masonry block, respectively, the elongated surface between said first end and said second end of the masonry reinforcing device defining a trough to be positioned over a single cell in said block, such that when said masonry reinforcement device is positioned over an exposed cell of hollow masonry block in a bottom course of block, and a top hollow masonry block is set over the bottom block and an adequate amount of mortar dropped into the exposed hollow cell of the top masonry block, the mortar will land in said trough to bind and adhere the interior hollow cell surfaces of both the bottom and top hollow masonry block and thereby form a secure bond between the blocks.

3. A masonry reinforcing device designed to be applied over two adjacent abutting hollow blocks in a course of hollow block in masonry construction wherein each of said abutting hollow blocks has a rectangular configuration, a top first end, a top second end and two exposed hollow cells formed by a lateral wall in the center of said hollow block, the two adjacent abutting hollow blocks presenting a top first end, a remote top second end, lateral walls and a thickened center section formed by the juxtaposition of abutting end walls of the adjacent abutting hollow block, said masonry reinforcement device consisting of a stiffened material and having a first end, a remote second end and an elongated surface between said first end and said remote second end, the first end and remote second end of said masonry reinforcing device being shaped to fit on the top of said first end of said two adjacent abutting hollow blocks and said remote top second end of said two adjacent abutting hollow blocks, said elongated surface between said first end and remote second end of said masonry reinforcement device being shaped to fit over the lateral walls and thickened center section formed by the juxtaposition of abutting end walls of said adjacent hollow block, and with said elongated surface forming several troughs to fit into said exposed hollow cells formed by said lateral walls in the center of said hollow blocks and such that when the masonry reinforcement device is positioned over exposed hollow cells of hollow masonry blocks in a bottom course of block, and a top course of hollow masonry block is set over the bottom course of block and an adequate amount of mortar dropped into an exposed hollow cell of the top masonry block, the mortar will land in said troughs to bind and adhere to the interior hollow cell surfaces of both the bottom and top hollow masonry blocks and thereby form a secure bond between the blocks.

4. A masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of stiffened material and comprising a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall, and wherein the elongated surface between the first end and second end, and between the troughs of the masonry reinforcement device has a lateral perforation for separating the reinforcement device for accommodating the thickened center lateral dividing wall of corner block.

5. In a method of reinforcing masonry hollow block construction the improvement comprising setting a masonry reinforcement device between courses of block and dropping mortar into the hollow core of a top block to land in the trough of the masonry reinforcement device to thereby vertically key the block set in the adjacent courses of block said masonry reinforcement device being defined as a masonry reinforcement device for reinforcing courses of hollow block in masonry construction, wherein said hollow block has a rectangular configuration, a top first and, a top second end and two exposed hollow cells formed by a lateral wall in the center of said hollow block, said masonry reinforcement device being made of stiffened material and comprising a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall.

6. A reinforced hollow block masonry wall wherein a masonry reinforcement device is in place between courses of block to reinforce the wall, said masonry reinforcement device being defined as a masonry reinforcement device for reinforcing courses of hollow block, wherein said hollow block has a rectangular configuration, a top first and, a top second end and two exposed hollow cells formed by a lateral wall the center of said hollow block, said masonry reinforcement device being made of stiffened material and comprising a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall.

7. In combination with a building wall, wherein at least two hollow core masonry blocks are stacked vertically and are staggered longitudinally, the blocks including an upper block and a lower block having respective communicating cores formed therein, and wherein the blocks have respective flat surfaces between which mortar is placed, a masonry reinforcing device disposed between the upper and lower blocks and including at least one trough portion which is received within the core of the lower block, such that additional mortar may be dropped through the core of the upper block to fall into the trough portion of the masonry reinforcing device in the lower block, the additional mortar being sufficient to be disposed conjointly between the respective cores of the upper and lower blocks, thereby vertically keying the upper and lower blocks together for substantially increased vertical strength of the building wall, and such that the additional mortar dropped through the core of the upper block does not displace the mortar between the respective flat surfaces of the upper and lower blocks.

8. The combination of claim 7, wherein the masonry reinforcing device comprises a strip disposed between the respective flat surfaces of the upper and lower blocks, the strip having a length substantially aligned with the longitudinal axis of the building wall and further having a width slightly less than the width of the respective cores in the upper and lower blocks, and the strip being bent at angles to the length thereof to form at least one trough portion in the strip.

9. A building wall structure made of block comprising in combination a wall made of courses of hollow block and between said courses of hollow block is set a masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of stiffened material and comprising a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall such that when the masonry reinforcement device is positioned over exposed hollow cells of hollow masonry block in a bottom course of hollow block, and a top course of hollow masonry block is set over the block in the bottom course of block and an adequate amount of mortar dropped into the exposed hollow cells of the top masonry block, the dropped mortar will land in said troughs to bind and adhere the interior hollow cell surfaces of both the bottom hollow block and the top hollow block and thereby form a secure bond between the blocks.

10. The building wall and masonry reinforcement device of claim 9 wherein the troughs of the masonry reinforcement device fit loosely in the hollow cells.

11. A building wall structure made of block comprising in combination a wall made of courses of hollow block and between said courses of hollow block is a set a masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of stiffened material and comprising a first end, a second end and and an elongated surface between said first end and said second end, the first end and second end of said masonry reinforcing device being shaped to fit on the top first end lateral wall in the center of said hollow masonry block, respectively, the elongated surface between said first end and said second end of the masonry reinforcing device defining a trough to be positioned over a single cell in said block, such that when said masonry reinforcement device is positioned over an exposed cell of hollow masonry block in a bottom course of block, and a top hollow masonry block is set over the bottom block and an adequate amount of mortar dropped into the exposed hollow cell of the top masonry block, the mortar will land in said trough to bind and adhere the interior hollow cell surfaces of both the bottom and top hollow masonry block and thereby form a secure bond between the blocks.

12. The building wall and masonry reinforcement device of claim 11 wherein said trough of the masonry reinforcement device fits loosely in the hollow cells.

13. A building wall structure made of block comprising in combination a wall made of courses of hollow block and between said courses of hollow block is set a masonry reinforcing device designed to be applied over two adjacent abutting hollow blocks in a course of hollow block in masonry construction wherein each of said abutting hollow blocks has a rectangular configuration, a top first end, a top second end and two exposed hollow cells formed by a lateral wall in the center of said hollow block, the two adjacent abutting hollow blocks presenting a top first end, a remote top second end, lateral walls and a thickened center section formed by the juxtaposition of abutting end walls of the adjacent abutting hollow block, said masonry reinforcement device being made of stiffened material and comprising a first end, a remote second end and an elongated surface between said first end and said remote second end, the first end and remote second end of said masonry reinforcing device being shaped to fit on the top of said first end of said two adjacent abutting hollow blocks and said remote top second end of said two adjacent abutting hollow blocks, said elongated surface between said first end and remote second end of said masonry reinforcement device being shaped to fit over the lateral walls and thickened center section formed by the juxtaposition of abutting end walls of said adjacent hollow block, and with said elongated surface forming several troughs to fit into said exposed hollow cells formed by said lateral walls in the center of said hollow blocks and such that when the masonry reinforcement device is positioned over exposed hollow cells of hollow masonry blocks in a bottom course of block, and a top course of hollow masonry block is set over the bottom course of block and an adequate amount of mortar dropped into an exposed hollow cell of the top masonry block, the mortar will land in said troughs to bind and adhere to the interior hollow cell surfaces of both the bottom and top hollow masonry blocks and thereby form a secure bond between the blocks.

14. The building wall and masonry reinforcement device of claim 13 wherein said several troughs of the masonry reinforcement device fit loosely in the hollow cells.

15. A masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of stiffened material and comprising a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall and having at said first end a perforated knock-out for accommodating an outdent in the cell of hollow masonry block, such that when the masonry reinforcement device is positioned over exposed hollow cells of hollow masonry block in a bottom course of hollow block, and a top course of hollow masonry block is set over the block in the bottom course of block and an adequate amount of mortar dropped into the exposed hollow cells of the top masonry block, the dropped mortar will land in said troughs to bind and adhere the interior hollow cell surfaces of both the bottom hollow block and the top hollow block and thereby form a secure bond between the blocks.

16. A masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of stiffened material and comprising a first end, a second end and an elongated surface between said first end and said second end, the first end and second end of said masonry reinforcing device being shaped to fit on the top first end lateral wall in the center of said hollow masonry block, respectively, the elongated surface between said first end and said second end of the masonry reinforcing device defining a trough to be positioned over a single cell in said block, and having at said first end a perforated knock-out for accommodating an outdent in the cell of hollow masonry block, such that when said masonry reinforcement device is positioned over an exposed cell of hollow masonry block in a bottom course of block, and a top hollow masonry block is set over the bottom block and an adequate amount of mortar dropped into the exposed hollow cell of the top masonry block, the mortar will land in said trough to bind and adhere the interior hollow cell surfaces of both the bottom and top hollow masonry block and thereby form a secure bond between the blocks.

17. A masonry reinforcing device designed to be applied over two adjacent abutting hollow blocks in a course of hollow block in masonry construction wherein each of said abutting hollow blocks has a rectangular configuration, a top first end, a top second end and two exposed hollow cells formed by a lateral wall in the center of said hollow block, the two adjacent abutting hollow blocks presenting a top first end, a remote top second end, lateral walls and a thickened center section formed by the juxtaposition of abutting end walls of the adjacent abutting hollow block, said masonry reinforcement device being made of stiffened material and comprising a first end, a remote second end and an elongated surface between said first end and said remote second end, the first end and remote second end of said masonry reinforcing device being shaped to fit on the top of said first end of said two adjacent abutting hollow blocks and said remote top second end of said two adjacent abutting hollow blocks, said elongated surface between said first end and remote second end of said masonry reinforcement device being shaped to fit over the lateral walls and thickened center section formed by the juxtaposition of abutting end walls of said adjacent hollow block, and with said elongated surface forming several troughs to fit into said exposed hollow cells formed by said lateral walls in the center of said hollow blocks and having at said first end a perforated knock-out for accommodating an outdent in the cell of hollow masonry block, such that when the masonry reinforcement device is positioned over exposed hollow cells of hollow masonry blocks in a bottom course of block, and a top course of hollow masonry block is set over the bottom course of block and an adequate amount of mortar dropped into an exposed hollow cell of the top masonry block, the mortar will land in said troughs to bind and adhere to the interior hollow cell surfaces of both the bottom and top hollow masonry blocks and thereby form a secure bond between the blocks.

18. A masonry reinforcement device for reinforcing courses of hollow block in masonry construction, wherein said hollow block has a rectangular configuration, a top first end, a top second end and two exposed hollow cells formed by a lateral wall in the center of said hollow block, said masonry reinforcement device being made of stiffened material and comprising a first end, a second end and an elongated surface between said first end and said second end, the first end and second end of said masonry reinforcing device being shaped to fit on the top first end and top second end of said hollow masonry block, respectively, the elongated surface between said first end and said second end of the masonry reinforcing device defining two troughs to be positioned over said two exposed hollow cells and lateral wall, between said two troughs of the masonry reinforcement device there is a lateral perforation for separating the reinforcement device for accommodating a thickened center lateral dividing wall of corner block, and with said first end of the device being provided with a perforated knock-out for accommodating an outdent in the cell of a hollow masonry block.

* * * * *